US006270451B1

(12) United States Patent
Palm et al.

(10) Patent No.: US 6,270,451 B1
(45) Date of Patent: Aug. 7, 2001

(54) PACKAGING MANUFACTURING APPARATUS

(75) Inventors: Magnus Palm, Tokyo (JP); Roberto Paltrinieri, Concordia Sulla Secchia Modena (IT)

(73) Assignee: Tetra Laval Holdings & Finance, S.A. (CH)

( * ) Notice: Subject to any disclaimer, the term of this patent is extended or adjusted under 35 U.S.C. 154(b) by 0 days.

(21) Appl. No.: 09/331,050

(22) PCT Filed: Dec. 26, 1997

(86) PCT No.: PCT/JP97/04874

§ 371 Date: Jun. 16, 1999

§ 102(e) Date: Jun. 16, 1999

(87) PCT Pub. No.: WO98/29308

PCT Pub. Date: Jul. 9, 1998

(30) Foreign Application Priority Data

Dec. 27, 1996 (JP) ..... 8-351302

(51) Int. Cl.[7] ..... B31B 49/02

(52) U.S. Cl. ..... 493/157; 493/59; 493/73; 493/165

(58) Field of Search ..... 493/59, 61, 69, 493/73, 80, 165, 171, 172, 174, 176, 178

(56) References Cited

U.S. PATENT DOCUMENTS 3,280,531 * 10/1966 Meyer-Jagenberg ..... 53/29
5,234,398 * 8/1993 Larsen ..... 493/183
5,681,253 * 10/1997 Owen et al. ..... 493/183

FOREIGN PATENT DOCUMENTS 60-204435 * 10/1985 (JP) ..... B65B/61/24
4-50225 * 4/1992 (JP) ..... B31B/1/28
8-301208 * 11/1996 (JP) ..... B65B/7/16

* cited by examiner

*Primary Examiner*—Ira S. Lazarus
*Assistant Examiner*—Hemant M. Desai
(74) *Attorney, Agent, or Firm*—Lorusso & Loud

(57) ABSTRACT

A package manufacturing apparatus which can fold a portion-to-be-processed accurately along a folding line without misalignment between the folding line and an actual fold. The package manufacturing apparatus comprises a pair of turnable arms (61), folding-line applicators (68, 80), and two pairs of bending arms (62) and compression coil springs (74). The pair of turnable arms (61) are disposed opposite to each other such that they are swingable. The folding-line applicators (68, 80) nip a portion-to-be-processed of a package in process of forming, form a predetermined folding line in the portion-to-be-processed, and temporarily fold the portion-to-be-processed along the folding line, while each of the turnable arms (61) turns. Each pair of the bending arms (62) and the compression coil springs (74) is disposed between one of the folding-line applicators (68, 80) and the corresponding turnable arm (61) and elastically brings the folding-line applicator (68, 80) into contact with the portion-to-be-processed. As the turnable arms (61) turn, the folding-line applicators (68, 80) nip the portion-to-be-processed of a package in process of forming, form a predetermined folding line in the portion-to-be-processed, and temporarily fold the portion-to-be-processed along the folding line. Since the temporary folding is performed in a state in which the portion-to-be-processed is nipped to form the folding line, the temporary folding can be performed accurately along the folding line. Thus, the portion-to-be-processed can be folded accurately along the folding line without misalignment between the folding line and an actual fold.

14 Claims, 13 Drawing Sheets

PACKAGING MANUFACTURING APPARATUS

TECHNICAL FIELD

The present invention relates to a package manufacturing apparatus.

BACKGROUND ART

Conventionally, packages containing drinks such as milk, juice, tea, and the like are formed from packaging paper materials laminated with plastic film, in view of reduced weight and prices of packages. In a package manufacturing apparatus for manufacturing such packages, a packaging paper material is fed longitudinally and undergoes longitudinal sealing so as to be formed into a tube, and the thus-formed tube is filled with contents. Subsequently, the tube undergoes lateral sealing and cutting, whereby a package in process of forming, i.e. a semi-finished package, is formed.

Then, when the semi-finished package is to be formed into a finished package, i.e. a final package, a portion-to-be-processed of the semi-finished package, for example, a sealed portion is folded onto the end face of the semi-finished package. Subsequently, a pair of flaps are formed at the folded sealed portion and folded onto the end face. Then, the shape of the tube is formed into a polygonal prism such as a hexagonal or octagonal prism.

In this case, the sealed portion of a semi-finished package must be favorably folded. To attain this end, a folding line is formed in the sealed portion of a semi-finished package through use of a dedicated folding-line-forming apparatus, and subsequently the sealed portion is folded along the folding line through use of a folding machine disposed separately from the folding-line-forming apparatus.

However, in the above conventional package manufacturing apparatus, the folding-line-forming apparatus is used to form a folding line, and the folding machine is used to fold the sealed portion. As a result, an actual fold may not be aligned with the formed folding line; i.e., the sealed portion may not be accurately folded along the formed folding line.

To solve the problem, the sealed portion can conceivably be folded while the folding line is being formed in the sealed portion. However, when a thick packaging material, a highly rigid packaging material, or a like packaging material is used, folding induces a large reaction force. This reaction force is apt to cause the misalignment between the folding line and an actual fold. As a result, not only does the sealed portion fail to be accurately folded, but also the sealed portion fails to be sufficiently folded, resulting in impaired appearance of a package.

An object of the present invention is to solve the problems involved in the conventional package manufacturing apparatus and to provide a package manufacturing apparatus capable of folding a portion-to-be-processed accurately along a folding line without misalignment between the folding line and an actual fold, to thereby improve the appearance of a package.

DISCLOSURE OF THE INVENTION

To achieve the above object, a package manufacturing apparatus of the present invention comprises a pair of arm means swingably disposed opposite to each other; folding-line applicators which nip a portion-to-be-processed of a package in process of forming, form a predetermined folding line in the portion-to-be-processed, and temporarily fold the portion-to-be-processed along the folding line while each of the arm means turns; and elastic contact means disposed between one of the folding-line applicators and the corresponding arm means in order to elastically bring the folding-line applicator into contact with the portion-to-be-processed.

In this case, while the arm means turns, the folding-line applicator nips the portion-to-be-processed of a package in process of forming, forms a predetermined folding line in the portion-to-be-processed, and temporarily folds the portion-to-be-processed along the folding line.

Since the temporary folding is performed in a state in which the portion-to-be-processed is nipped to form the folding line, the portion-to-be-processed can be folded accurately along the folding line without misalignment between the folding line and an actual fold.

Also, since the folding-line applicator is elastically brought into contact with the portion-to-be-processed, even when a reaction force induced from temporary folding is imposed on the folding-line applicator, the reaction force can be absorbed by the elastic contact means. Accordingly, a package in process of forming is free of any displacement which would otherwise occur due to the reaction force. Thus, an actual fold is aligned with the folding line; i.e., the portion-to-be-processed can be folded accurately along the folding line.

In another package manufacturing apparatus of the present invention, the elastic contact means comprises a bending arm which is disposed swingably in relation to the arm means and on the tip end portion of which is fixed the folding-line applicator, and urging means which is disposed between the arm means and the bending arm and urges the folding-line applicator toward the portion-to-be-processed.

In this case, since the folding-line applicator is urged toward the portion-to-be-process, a reaction force induced by a package in process of forming can be absorbed by the urging means. Accordingly, the package is free of any displacement which would otherwise occur due to the reaction force, and thus a folding line can be formed accurately.

Also, since the bending arm and urging means constitute the elastic contact means, the structure of the package manufacturing apparatus can be simplified, resulting in a reduction in price.

In still another package manufacturing apparatus of the present invention, each of the arm means comprises two turnable arms that are disposed to face both widthwise end portions of the portion-to-be-processed.

In this case, since the folding-line applicators nip a package at four positions of the portions-to-be-processed of the package, even when the package has a polygonal prism shape, a folding line can be formed in the portions-to-be-processed, and the portions-to-be-processed can be temporarily folded along the respective folding lines.

In a further package manufacturing apparatus of the present invention, each of the bending arms is independently supported by the corresponding turnable arm, and the urging means is disposed between the turnable arm and the bending arm.

In this case, since each bending arm is independently supported by the corresponding turnable arm, a package can be reliably nipped at four positions of the portions-to-be-processed of the package by the folding-line applicators.

A still further package manufacturing apparatus of the present invention comprises a guide block disposed in correspondence with a portion-to-be-processed of a package in process of forming, and moving means for moving the package relative to the guide block.

The guide block has a groove portion formed therein for the purpose of folding the portion-to-be-processed to thereby form a flap.

In this case, since folding the portion-to-be-processed and positioning the package can be performed merely through use of the groove portion, the is no need for disposing a separate package-positioning mechanism. Thus, the apparatus becomes not only simple in structure but also easy to control. Also, since the package can be positioned while the portion-to-be-processed is being folded, positioning can be performed at high precision.

In a still further package manufacturing apparatus of the present invention, the portion-to-be-processed is a sealed portion, and the moving means moves the package in a direction perpendicular to the sealed surface of the sealed portion.

In this case, merely through movement of the package in a direction perpendicular to the sealed surface of the sealed portion, the portion-to-be-processed can be folded and the package can be positioned. Thus, there is no need for preparing a wide operation area for folding and positioning.

In a still further package manufacturing apparatus of the present invention the groove portion includes a leading portion for leading the portion-to-be-processed into the groove portion, and one of two wall portions at the leading portion is partially cut.

In this case, as the vicinity of the portion-to-be-processed slides along the cut, the vicinity of the portion-to-be-processed is deformed accordingly.

A still further package manufacturing apparatus of the present invention comprises a pair of turnable support plates which are disposed swingably and in correspondence with the flaps of a package in process of forming and which press the flaps against the end face of the package while turning, and turning means for turning the turnable support plates.

The turnable support plate has a flap receiving recess formed therein for receiving the flap.

In this case, as the turnable support plate turns, the flap is received by the flap receiving recess; thus, the flap has no play. Accordingly, even when a thick packaging material, a highly rigid packaging material, or a like packaging material is used, flaps can be reliably folded onto the end face of a package in process of forming. Thus, folding can be done as designed to thereby improve the appearance of a finished product.

In a still further package manufacturing apparatus of the present invention, a pad member is attached onto the turnable support plate, and the flap receiving recess is formed in the pad member.

In a still further package manufacturing apparatus of the present invention, end-face-pressing protrusions for pressing the end face of the package are formed on both sides of the flap receiving recess.

In this case, since the end face of the package is pressed on both sides of the flap receiving recess, the flap does not come off the flap receiving recess. Thus, folding can be reliably performed.

In a still further package manufacturing apparatus of the present invention, the flap receiving recess has a shape corresponding to that of the flap.

In this case, the flap can be reliably accommodated in the flap receiving recess.

BEST MODE FOR CARRYING OUT THE INVENTION

The embodiments of the present invention will next be described in detail with reference to the drawings.

As shown in FIGS. 1–4, in a preceding filling step, a semi-finished package 2 is filled with drink such as milk, juice, tea, or the like in a predetermined amount through use of an unillustrated filling machine. In a package manufacturing apparatus 1, the semi-finished package 2 filled with the drink is processed into the predetermined shape, obtaining a finished product, i.e. a final package 5. Subsequently, the final package 5 is sent to an encasing step, an inspection step, and the like.

Figure 1:
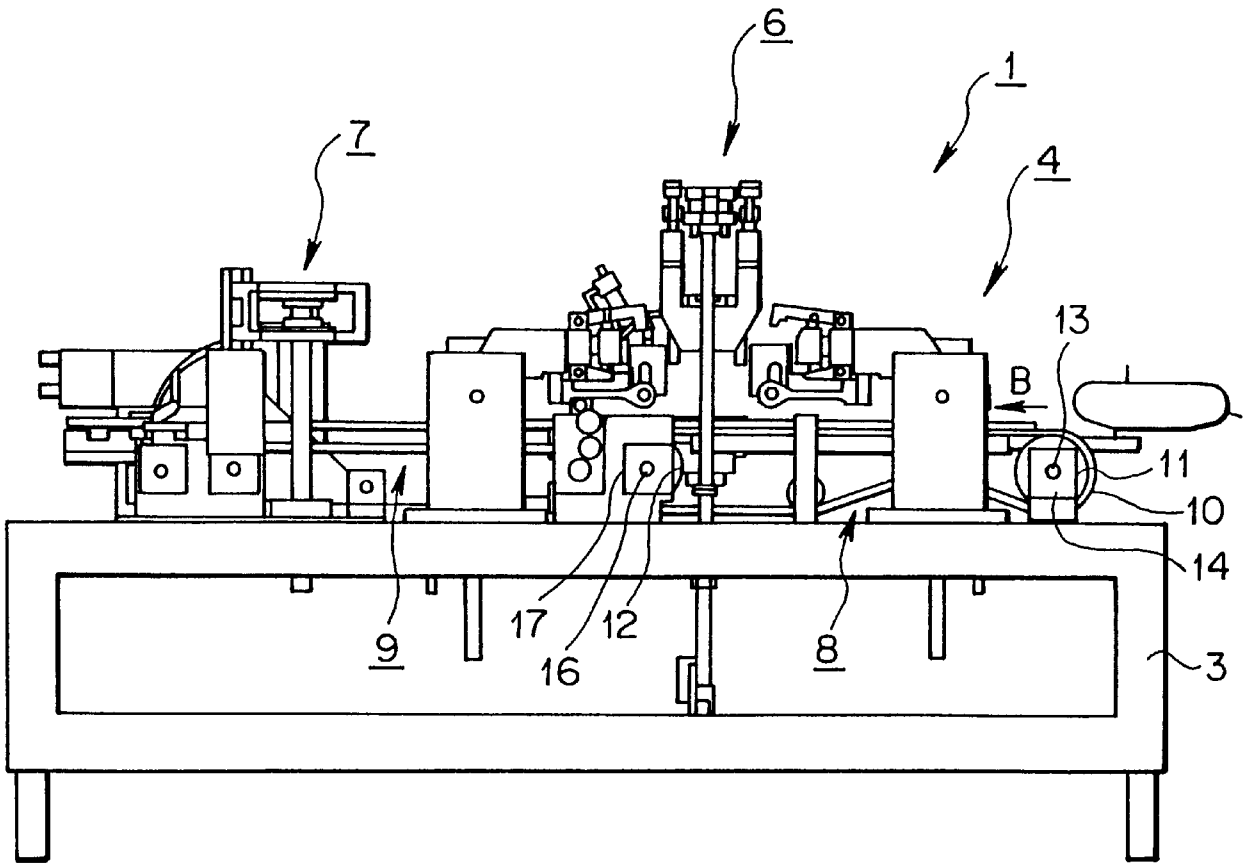
FIG. 1 is a side view of a package manufacturing apparatus according to an embodiment of the present invention.

As shown in FIG. 1, on a base 3 are disposed, from right to left in FIG. 1, a standby section 4 disposed on the filling machine side, a forming section 6 for processing the semi-finished package 7 conveyed from the standby section 4 into a predetermined shape to thereby form the final package 5, and a delivery section 7 for delivering the final package 5 formed in the forming section 6. Also, on the base 3 are disposed a semi-finished package conveyance mechanism 8 for conveying the semi-finished package 2 to the standby section 4 and the forming section 6, and a final package conveyance mechanism 9 for conveying the final package 5 to the delivery section 7.

Figure 2:
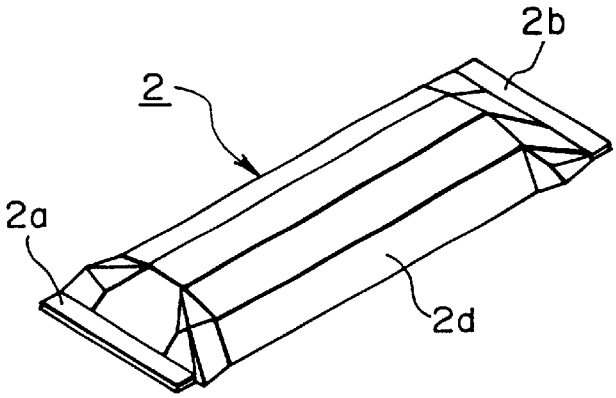
FIG. 2 is a first perspective view showing a package manufacturing step in the embodiment of the present invention.

As shown in FIG. 2, sealed portions 2*a* and 2*b* extending laterally and serving as portions-to-be-processed are formed at both longitudinal end portions of the semi-finished package 2.

In the semi-finished package conveyance mechanism 8, a plurality of semi-finished package conveyors 10 are disposed in parallel with each other and run from the standby section 4 to the forming section 6 in the conveyance direction of the semi-finished package 2 (in the direction of arrow B in FIG. 1). The semi-finished package conveyors 10 are looped around and mounted on sprockets 11 disposed on the filling machine side of the standby section 4 and sprockets 12 disposed on the delivery section 7 side of the forming section 6, and are extend between the sprockets 11 and 12.

The sprockets 11, which the semi-finished package conveyors 10 are looped around and mounted on, are fixedly mounted on a shaft 13 which is located on the standby section side and extends substantially perpendicular to the conveyance direction of the semi-finished package 2. One end of the shaft 13 is connected to a drive shaft of a conveyance motor 14 mounted fixedly on the base 3, and the other end is rotatably supported by an unillustrated bearing mounted fixedly on the base 3.

The sprockets 12, which the semi-finished package conveyors 10 are looped around and mounted on, are fixedly mounted on a shaft 16 which is located on the forming section side and extends substantially perpendicular to the conveyance direction of the semi-finished package 2. Both ends of the shaft 16 are rotatably supported by bearings 17. Through operation of the conveyance motor 14, a plurality of the semi-finished package conveyors 10 are concurrently run in the conveyance direction of the semi-finished package 2.

A plurality of unillustrated carriers are fixedly mounted on the semi-finished package conveyor 10 in a manner projecting sideward. Each carrier is fixedly mounted on the semi-finished package conveyor 10 through one end thereof and projects toward the adjacent semi-finished package conveyor 10, i.e. in parallel with the shafts 13 and 16. The distance between adjacent carriers on the semi-finished package conveyor 10 is set to correspond to the length of the semi-finished package 2, so that the sealed portions 2*a* and 2*b* of the semi-finished package 2 are supported by the adjacent upstream carrier and downstream carrier as arranged in the conveyance direction of the semi-finished package 2.

Figure 3:
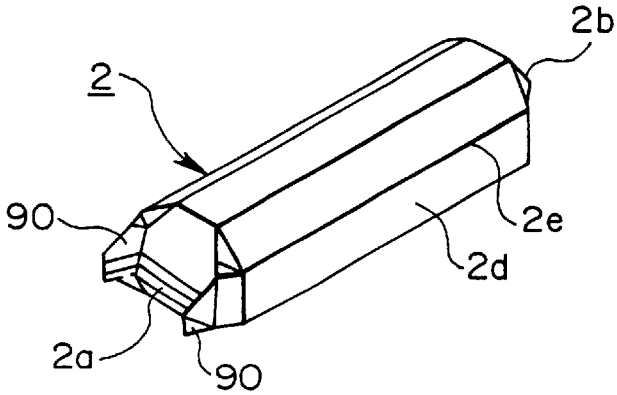
FIG. 3 is a second perspective view showing a package manufacturing step in the embodiment of the present invention.
Figure 4:
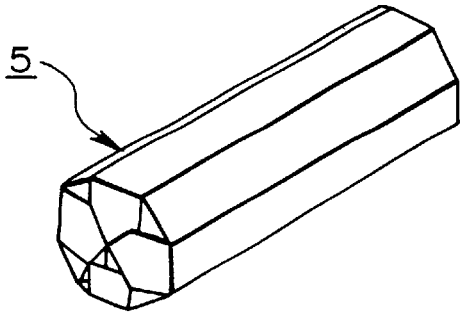
FIG. 4 is a third perspective view showing a package manufacturing step in the embodiment of the present invention.

In the forming section 6, the semi-finished package 2 undergoes folding as shown in FIG. 3. That is, the sealed portions 2*a* and 2*b* are folded onto the respective end faces of the semi-finished package 2. Subsequently, both side portions of each of the sealed portions 2*a* and 2*b*are temporarily folded to thereby form flaps 90. Further, a trunk portion 2*d* is folded along folding lines 2*e* to thereby obtain a polygonal prism. Then, the flaps 90 are folded onto the end faces of the semi-finished package 2, whereby there is formed the final package 5 having a polygonal prism shape, i.e. an octagonal prism shape as shown in FIG. 4. The final package 5 is conveyed to the delivery section 7 by the final package conveyance mechanism 9.

Next, the forming section 6 will be described with reference to FIGS. 5–9.

Figure 5:
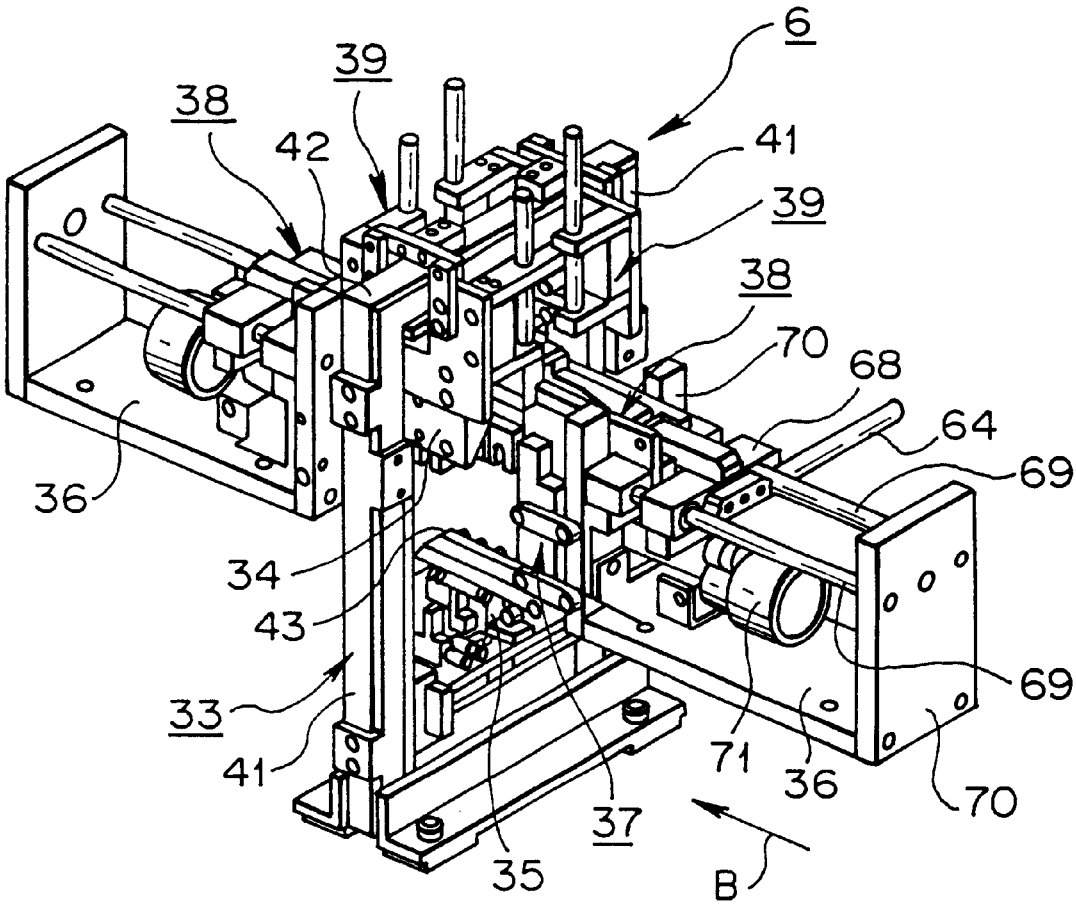
FIG. 5 is a perspective view showing a forming section in the embodiment of the present invention.

As shown in FIG. 5, the forming section 6 is disposed within and at the upper and lower portions of a support frame 33 mounted upright on the base 3. The forming section 6 includes an upper die 34 and a lower die 35 for forming the semi-finished package 2 into an octagonal prism shape; guiding-and-folding mechanisms 37 which are supported by support plate members 36 disposed on both sides of the support frame 33, i.e. on the upstream and downstream sides of the support frame 33 in the conveyance direction of the semi-finished package 2 (in the direction of arrow B) and which are adapted to position the semi-finished package 2 in a predetermined position on the lower die 35 and to fold the sealed portions 2*a* and 2*b* in the same direction; folding-line-forming devices 38 supported by the support plate members 36 and adapted to form folding lines adjacent to the sealed portions 2*a* and 2*b*; folding mechanisms 39 for folding both sides of the sealed portions 2*a* and 2*b*; and unillustrated hot-air-blowing means for melting the surfaces of overlapped portions of the semi-finished package 2 in order to bond the folded portions.

The support frame 33 includes a pair of vertical frame members 41 mounted upright on the base 3 in parallel with each other and disposed perpendicular to the conveyance direction of the semi-finished package 2 and a horizontal frame member 42 which connects the upper ends of the vertical frame members 41 together, so that the support frame 33 is formed in a rectangular shape. The lower die 35 is disposed within and on the base 3 side of the support frame 33, and the upper die 34 is disposed on the horizontal frame member 42 to oppose to the lower die 35.

Figure 6:
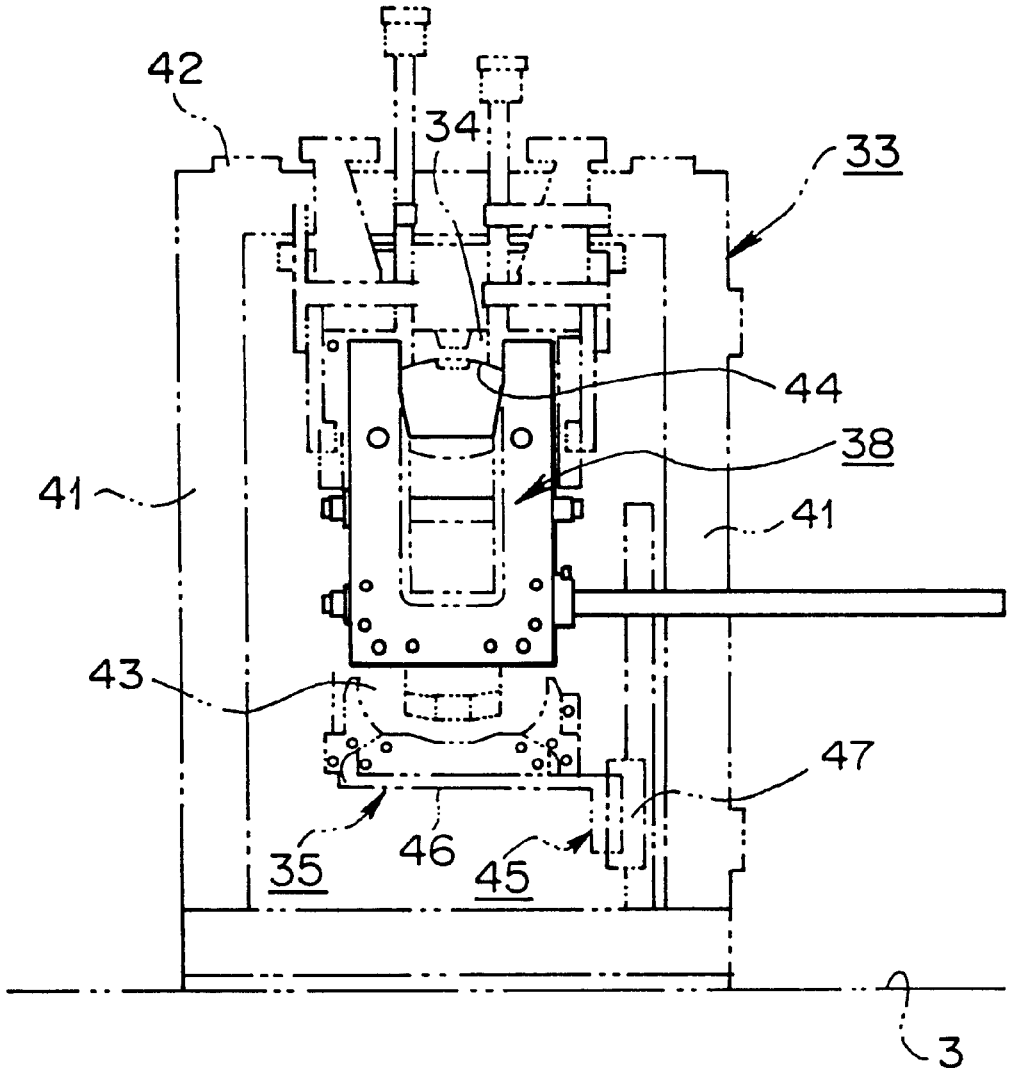
FIG. 6 is a side view of the forming section in the embodiment of the present invention.

As shown in FIG. 6, the lower die 35 has an arc-shaped forming face 43 curved upward, and the upper die 34 has an arc-shaped forming face 44 curved downward. The semi-finished package 2 is held between the upper die 34 and the lower die 35 to thereby be formed into an octagonal prism shape.

The lower die 35 is vertically moved by a lift mechanism 45 to thereby move toward or apart from the upper die 34. The lift mechanism 45 includes a lift member 46 whose both side portions are movably supported by the vertical frame members 41, and a drive motor 47 serving as moving means for lifting the lift member 46.

Before the semi-finished package 2 is formed, i.e. when the lower die 35 is apart from the upper die 34, the lower die 35 is located below the semi-finished package conveyance mechanism 8 (FIG. 1). In this state, the forming face 43 faces the portion of the semi-finished package 2 held between carriers. As the lower die 35 rises, the forming face 43 abuts the lower portion of the semi-finished package 2 supported by the carriers. Then, as the lower die 35 rises further, the trunk portion 2*d* of the semi-finished package 2 is held between the lower die 35 and the upper die 34. While the semi-finished package 2 placed on the lower die 35 is being raised, the sealed portions 2*a* and 2*b* are folded toward the base 3 side by the guiding-and-folding mechanism 37, and the semi-finished package 2 is positioned in a predetermined position on the forming face 43 of the lower die 35.

Figure 7:
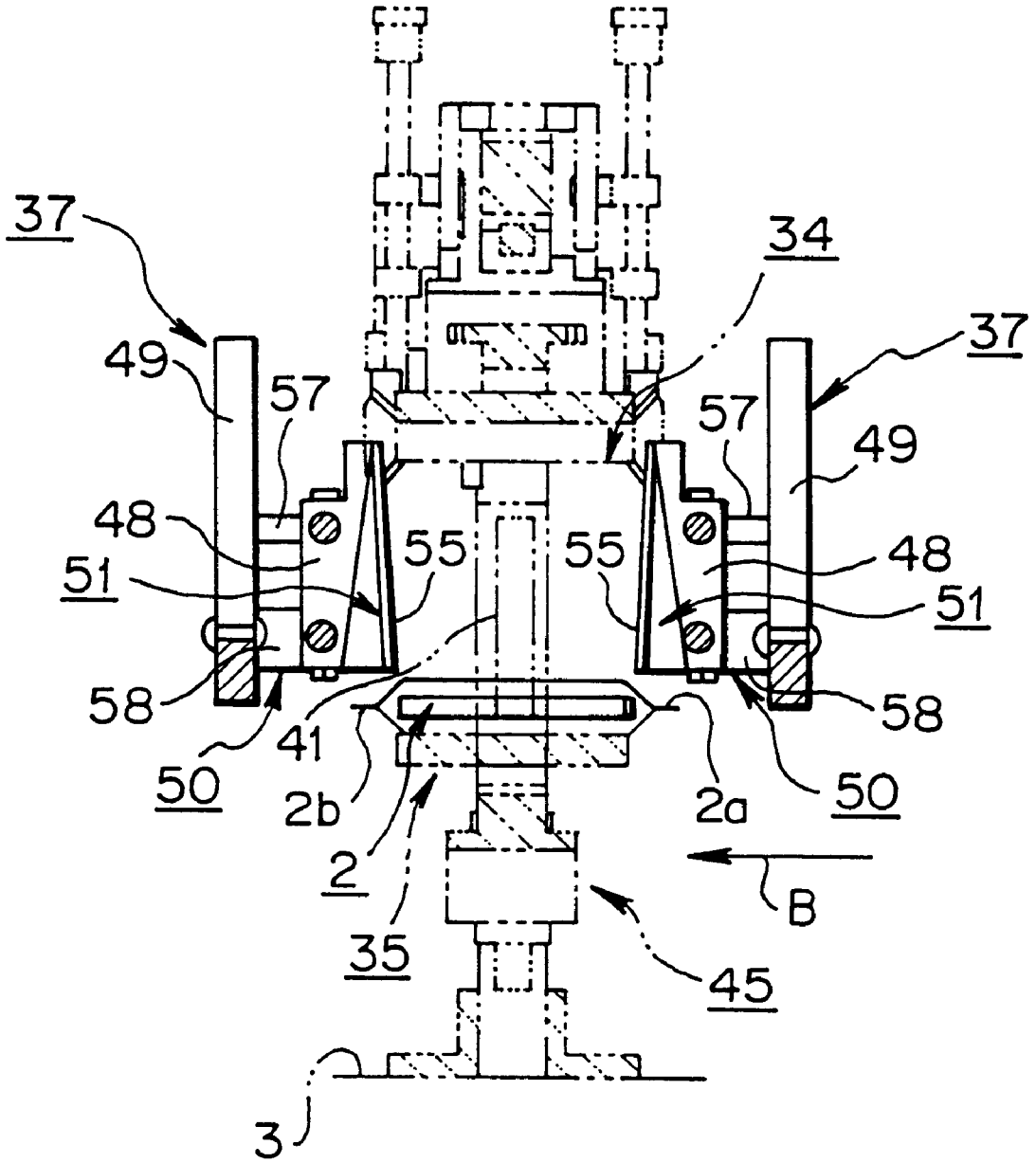
FIG. 7 is a front view showing the upper die, lower die, and guiding-and-folding mechanism of the forming section in the embodiment of the present invention.
Figure 8:
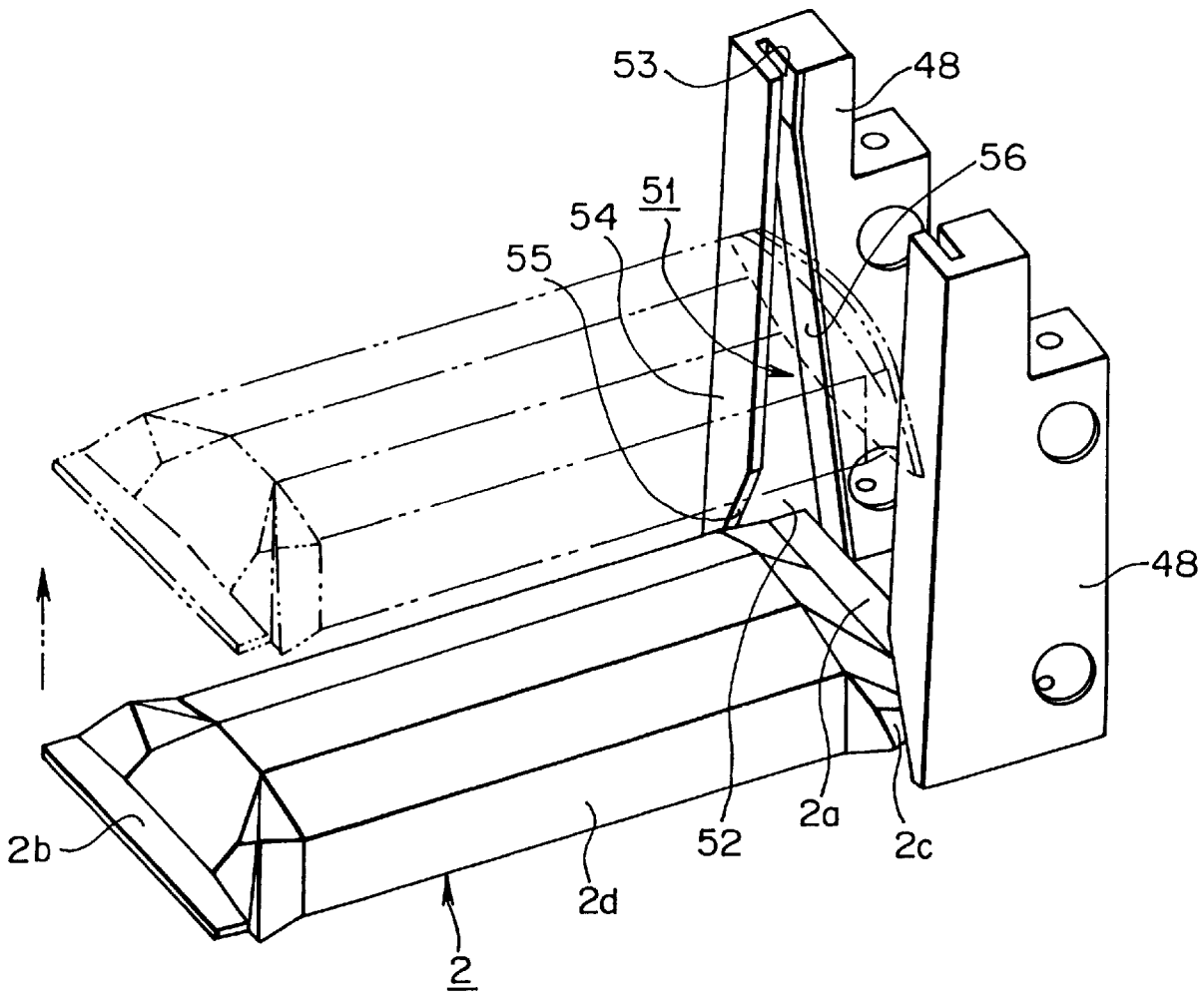
FIG. 8 is a perspective view illustrating operation of guide blocks in the embodiment of the present invention.

As shown in FIGS. 7 and 8, the guiding-and-folding mechanism 37 includes four guide blocks 48 disposed in correspondence with both lateral side portions of each of the sealed portions 2*a* and 2*b* and parallel link mechanisms 50 for connecting the guide blocks 48 with respective support plate members 49.

A groove portion 51 is formed in the inner side of each guide block 48. The groove portion 51 includes a relatively wide leading portion 52 formed at its lower section and a relatively narrow positioning portion 53 at its upper section. The width of the groove portion 51 is gradually narrowed from the leading portion 52 to the positioning portion 53. In the leading portion 52, one of two wall portions 54 defining the groove portion 51 is partially cut to thereby form a slant surface 55. Both side portions of each of the sealed portions 2*a* and 2*b* placed on the lower die 35 are led into the respective leading portions 52. As the lower die 35 rises, both side portions of each of the sealed portions 2*a* and 2*b* move toward the respective positioning portions 53.

Figure 9:
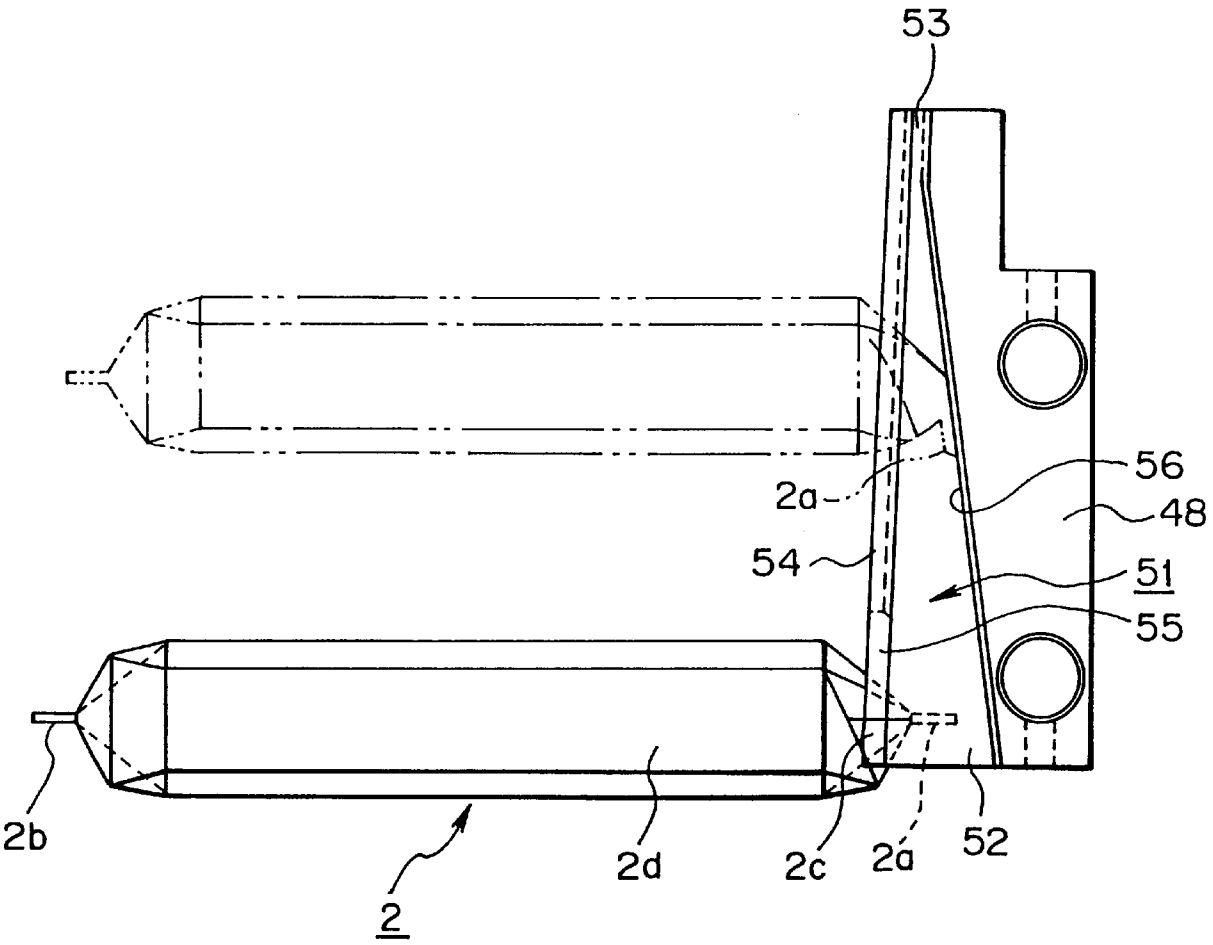
FIG. 9 is a side view illustrating operation of the guide blocks in the embodiment of the present invention.

In this case, as shown in FIG. 9, when the semi-finished package 2 is raised and the sealed portions 2*a* and 2*b* are led to the substantially intermediate positions of the leading portions 52, both side portions 2*c* located in the vicinity of the sealed portions 2*a* and 2*b* slide along the slant surfaces 55 of the wall portions 54 and deform, and subsequently move further upward along the wall portions 54. As the semi-finished package 2 is further raised, the tips of both side portions of each of the sealed portions 2*a* and 2*b* abut the respective inner walls 56 of the groove portions 51, and the sealed portions 2*a* and 2*b* are folded downward because of the effect of sliding, whereby the flaps 90 are formed. At this time, the both side portions of each of the sealed portions 2*a* and 2*b* abut the respective inner walls 56. Then, when the sealed portions 2*a* and 2*b* reach the respective positioning portions 53, the semi-finished package 2 is positioned in a predetermined position.

The parallel link mechanism 50 for connecting the guide block 48 to the support plate member 49 includes two parallel links 57 and 58. One end of each of the parallel links 57 and 58 is supported in a turnable manner by the support plate member 49, and the other end is supported in a turnable manner by the guide block 48. The turnable shaft of the parallel link 58 located under the parallel link 57 is connected to the drive shaft of an unillustrated motor. By running the motor, the lower parallel link 58 is turned, and thus the guide block 48 moves in parallel with the support plate member 49 (in the vertical direction in FIG. 7).

When the semi-finished package 2 is raised, the guide blocks 48 are located in their upper positions. After the sealed portions 2*a* and 2*b* reach the respective positioning portions 53, the guide blocks 48 are moved to their lower positions, and consequently the sealed portions 2*a* and 2*b* come off the respective groove portions 51. In this state of the semi-finished package 2, both side portions of each of the sealed portions 2*a* and 2*b* are folded substantially perpendicularly downward, and the semi-finished package 2 is positioned on the lower die 35 in a predetermined position.

In the guiding-and-folding mechanism 37, through lead of the sealed portions 2*a* and 2*b* into the respective leading portions 52 of the groove portions 51 and through rise of the semi-finished package 2, the inner walls 56 cause the sealed portions 2*a* and 2*b* to be folded downward, and the positioning portions 53 cause the semi-finished package 2 to be positioned. Accordingly, merely through use of the groove portions 51, the sealed portions 2*a* and 2*b* are folded, and the semi-finished package 2 is positioned. Thus, there is no need for disposing a separate positioning mechanism for the semi-finished package 2, thereby not only simplifying the structure but also facilitating control. Also, the semi-finished package 2 can be positioned while the sealed portions 2*a* and 2*b* are being folded, thereby enabling high-precision positioning.

Merely through movement of the semi-finished package 2 in a direction perpendicular to the sealed surfaces of the sealed portions 2*a* and 2*b*, the sealed portions 2*a* and 2*b* can be folded, and the semi-finished package 2 can be positioned. Therefore, there is no need for preparing a wide operation area for folding and positioning.

Further, the slant surfaces 55, along which both side portions 2*c* located in the vicinity of the sealed portions 2*a* and 2*b* slide, are formed in the respective groove portions 51 so as to forcibly fold both side portions 2*c* in the same direction as that in which the sealed portions 2*a* and 2*b* are folded. Accordingly, even when the both side portions 2*c* deform and swell, the sealed portions 2*a* and 2*b* can be reliably and readily folded without any deformation.

After the semi-finished package 2 is positioned on the lower die 35 in a predetermined position as described above, the folding-line-forming devices 38 form folding lines in the adjacencies of the sealed portions 2*a* and 2*b*. As shown in FIG. 5, the folding-line-forming devices 38 are supported by the support plate members 36 located on both sides of the support frame 33. Reference numeral 64 denotes a shaft, numeral 68 denotes a movable block, numeral 69 denotes guide shafts, numeral 70 denotes vertical plate members, and numeral 71 denotes a motor.

Next, the folding-line-forming device 38 will be described with references to FIGS. 10 and 11.

Figure 10:
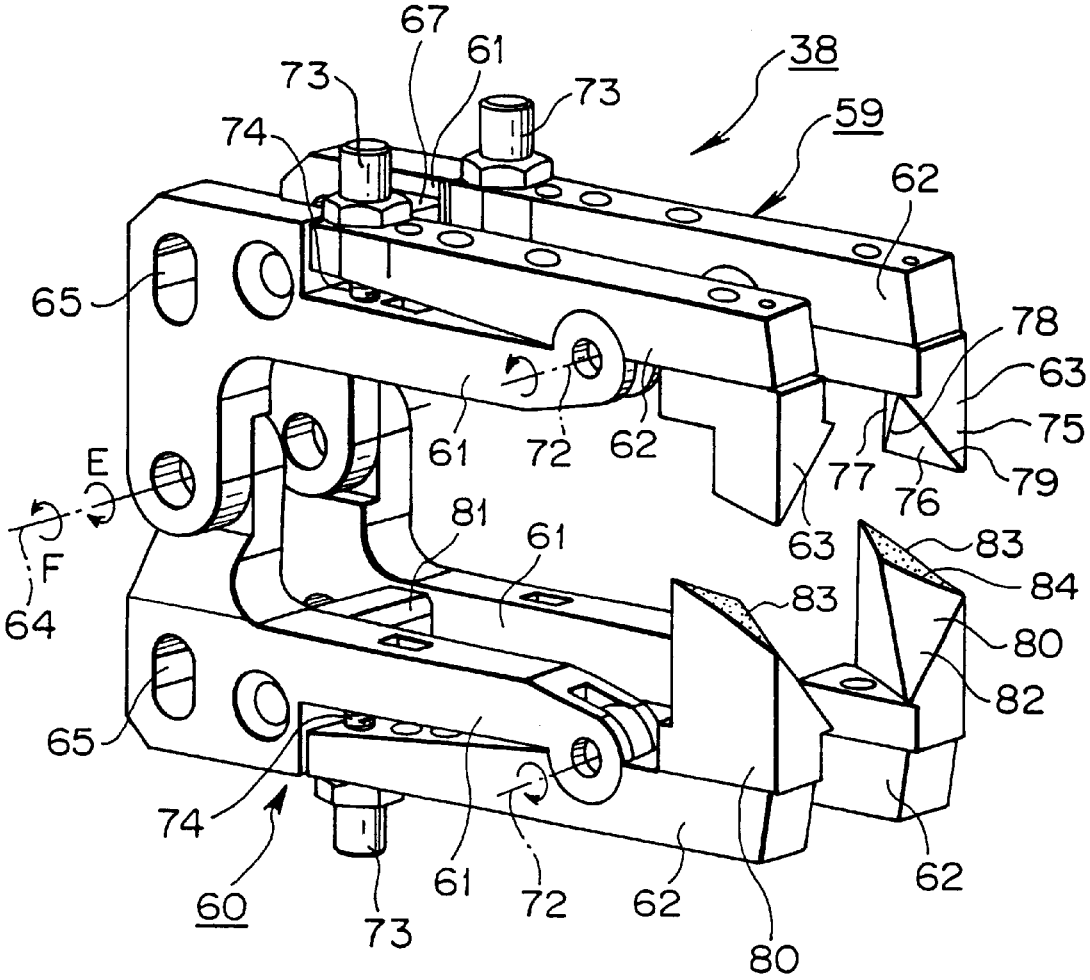
FIG. 10 is a perspective view of a folding-line-forming device in the embodiment of the present invention.
Figure 11:
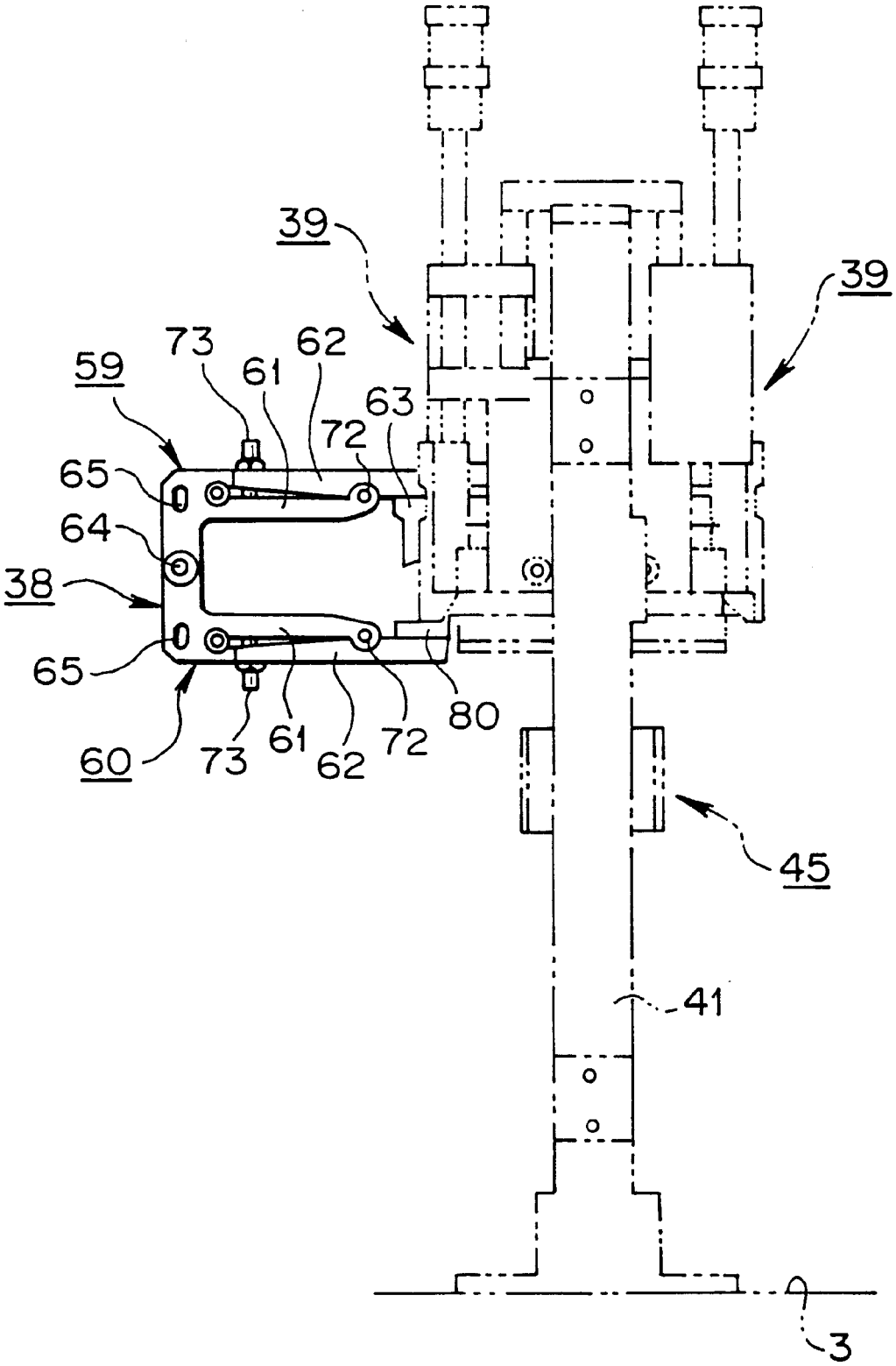
FIG. 11 is a side view of the folding-line-forming device in the embodiment of the present invention.

As shown in FIG. 10, the folding-line-forming device 38 includes an upper arm section 59 and a lower arm section 60, which are located opposite to each other.

The upper arm section 59 includes a pair of turnable arms 61 serving as arm means which are disposed in parallel with each other and apart from each other at a distance substantially equal to the widthwise dimension of the sealed portions 2*a* and 2*b* of the semi-finished package 2 (FIG. 9); a pair of bending arms 62 whose intermediate portions are swingably supported by the respective tip portions of the turnable arms 61; and folding-line applicators 63 fixedly attached to the respective tip portions of the bending arms 62.

In the upper arm section 59, the turnable arms 61 have a shape of letter L and are supported in a turnable manner at their one end by the shaft 64. The shaft 64 is supported at its both ends by a pair of unillustrated support blocks attached fixedly to the support plate member 36 (FIG. 5). Each turnable arm 61 has an elongated hole 65 formed in its intermediate portion, i.e. in the corner portion of its bent L-shape, and the thus-formed elongated holes 65 are coaxial. Unillustrated shaft portions projecting from one side of an upper connection block 67 are inserted into the respective elongated holes 65. The other side of the upper connection block 67 is fixedly attached to the movable block 68. A pair of the guide shafts 69 penetrate the movable block 68. The guide shafts 69 extend in parallel with each other between the vertical plate members 70 located at both ends of the support plate member 36. As the motor 71 is driven, the movable block 68 is moved toward or apart from one of the vertical plate members 70.

Accordingly, when the movable block 68 is moved toward the vertical plate member 70 located on the support frame 33 side through operation of the motor 71, the turnable arms 61 are turned about the shaft 64 in the direction of arrow E. When the movable block 68 is moved apart from the vertical plate member 70, the turnable arms 61 are turned about the shaft 64 in the direction of arrow F.

The intermediate portion of the bending arm 62 is supported by the tip portion of the turnable arm 61 so as to be swingable about a rotary shaft 72. A plunger 73 is disposed on the rear end portion of the bending arm 62. A compression coil spring 74 is disposed between the turnable arm 61 and the bending arm 62 in correspondence with the plunger 73. Thus, the compression coil spring 74 applies force continuously and elastically to the bending arm 62 such that the tip portion of the bending arm 62 is positioned downward.

The folding-line applicator 63 has three contact surfaces 75–77, which face in different directions and neighbor each other via ridgelines 78 and 79.

The lower arm section 60 has the same structure as that of the upper arm section 59 and is disposed opposite to the upper arm section 59.

That is, the lower arm section 60 includes a pair of turnable arms 61 disposed opposite to the turnable arms 61 of the upper arm section 59, a pair of bending arms 62, and folding-line applicators 80. Each turnable arm 61 is supported in a turnable manner at its one end by the shaft 64. Each turnable arm 61 has an elongated hole 65 formed in its intermediate portion, i.e. in the corner portion of its bent L-shape, and the thus-formed elongated holes 65 are coaxial. Unillustrated shaft portions projecting from one side of a lower connection block 81 are inserted into the respective elongated holes 65. The other side of the lower connection block 81 is fixedly attached to the movable block 68. As the motor 71 is driven, the movable block 68 is moved toward or apart from one of the vertical plate members 70.

Accordingly, when the movable block 68 is moved toward the vertical plate member 70 located on the support frame 33 side through operation of the motor 71, the turnable arms 61 are turned about the shaft 64 in the direction of arrow E. When the movable block 68 is moved apart from the vertical plate member 70, the turnable arms 61 are turned about the shaft 64 in the direction of arrow F.

The intermediate portion of the bending arm 62 is supported by the tip portion of the turnable arm 61 so as to be swingable about a rotary shaft 72. A plunger 73 is disposed on the rear end portion of the bending arm 62. A compression coil spring 74 is disposed between the turnable arm 61 and the bending arm 62 in correspondence with the plunger 73. Thus, the compression coil spring 74 applies force continuously and elastically to the bending arm 62 such that the tip portion of the bending arm 62 is positioned upward.

The folding-line applicator 80 is fixedly attached to the tip portion of the bending arm 62 and faces upward. The folding-line applicator 80 has two contact surfaces 82 and 83, which face in different directions and neighbor each other via a ridgeline 84.

The bending arm 62 and the compression coil spring 74 constitute elastic contact means for elastically bringing the folding-line applicators 63 and 80 into contact with the sealed portions 2*a* and 2*b*.

In the folding-line-forming device 38 described above, each of the sealed portions 2*a* and 2*b* is nipped by the contact surfaces 75–77 of the folding-line applicators 63 of the upper arm section 59 and the contact surfaces 82 and 83 of the folding-line applicators 80 of the lower arm section 60 to thereby form folding lines in each of the sealed portions 2*a* and 2*b* in correspondence with the ridgelines 78, 79, and 84; and as the turnable arms 61 turn, the contact surfaces 75–77, 82, and 83 press each of the sealed portions 2*a* and 2*b* to thereby temporarily fold each of the sealed portions 2*a* and 2*b* along the folding lines. Through this temporary folding and pressing effected by the unillustrated pressing members of the folding mechanisms 39, the flaps 90 (FIG. 3) are formed at both side portions of each of the sealed portions 2*a* and 2*b*.

In operation, the upper arm section 59 and the lower arm section 60 are turned about the shaft 64 so as to approach each other, so that the contact surfaces 75–77, 82, and 83 of the folding-line applicators 63 and 80 abut the semi-finished package 2. At this time, the packaging material of the semi-finished package 2 imposes a reaction force on the bending arms 62. However, since the bending arms 62 are subjected to an elastic force induced by the compression coil springs 74, the reaction force is absorbed through the turning of the bending arms 62 against the elastic force induced by the compression coil springs 74. Accordingly, an excessive force is not applied to the semi-finished package 2, so that the reaction force doe snot cause any displacement of the semi-finished package 2. As a result, actual folds are aligned with the folding lines, i.e. the sealed portions 2*a* and 2*b* can be accurately folded along the folding lines.

Also, as described previously, in the folding-line-forming device 38, through the turning of a pair of the turnable arms 61, while each of the sealed portions 2*a* and 2*b* is nipped by the contact surfaces 75–77, 82, and 83 of the folding-line applicators 63 and 80, the folding lines corresponding to the ridgelines 78, 79, and 84 are formed in each of the sealed portions 2*a* and 2*b*, and each of the sealed portions 2*a* and 2*b* is temporarily folded along the folding lines. Accordingly, not only are accurately formed the folding lines, but also the sealed portions 2*a* and 2*b* can be temporarily folded along the folding lines in an accurate manner.

Further, since the contact surfaces 75–77, 82, and 83 of the folding-line applicators 63 and 80 nip each of the sealed portions 2*a* and 2*b* in four directions, even when the semi-finished package 2 has a polygonal prism shape, folding lines can be formed in each of the sealed portions 2*a* and 2*b*, and the sealed portions 2*a* and 2*b* can be temporarily folded along the folding lines.

Also, since the bending arms 62 are supported by the respective turnable arms 61 independently of each other, each of the sealed portions 2*a* and 2*b* can be reliably nipped in four directions by the folding-line applicators 63 and 80.

When folding lines are formed in the semi-finished package 2 as described above, the upper arm section 59 and the lower arm section 60 open apart from each other, and the sealed portions 2*a* and 2*b* are folded along the folding lines by the folding mechanisms 39. Reference numeral 3 denotes the base, numeral 41 denotes the vertical frame members, and numeral 45 denotes the lift mechanism.

Next, the folding mechanism 39 will be described with reference to FIGS. 12 and 13.

Figure 12:
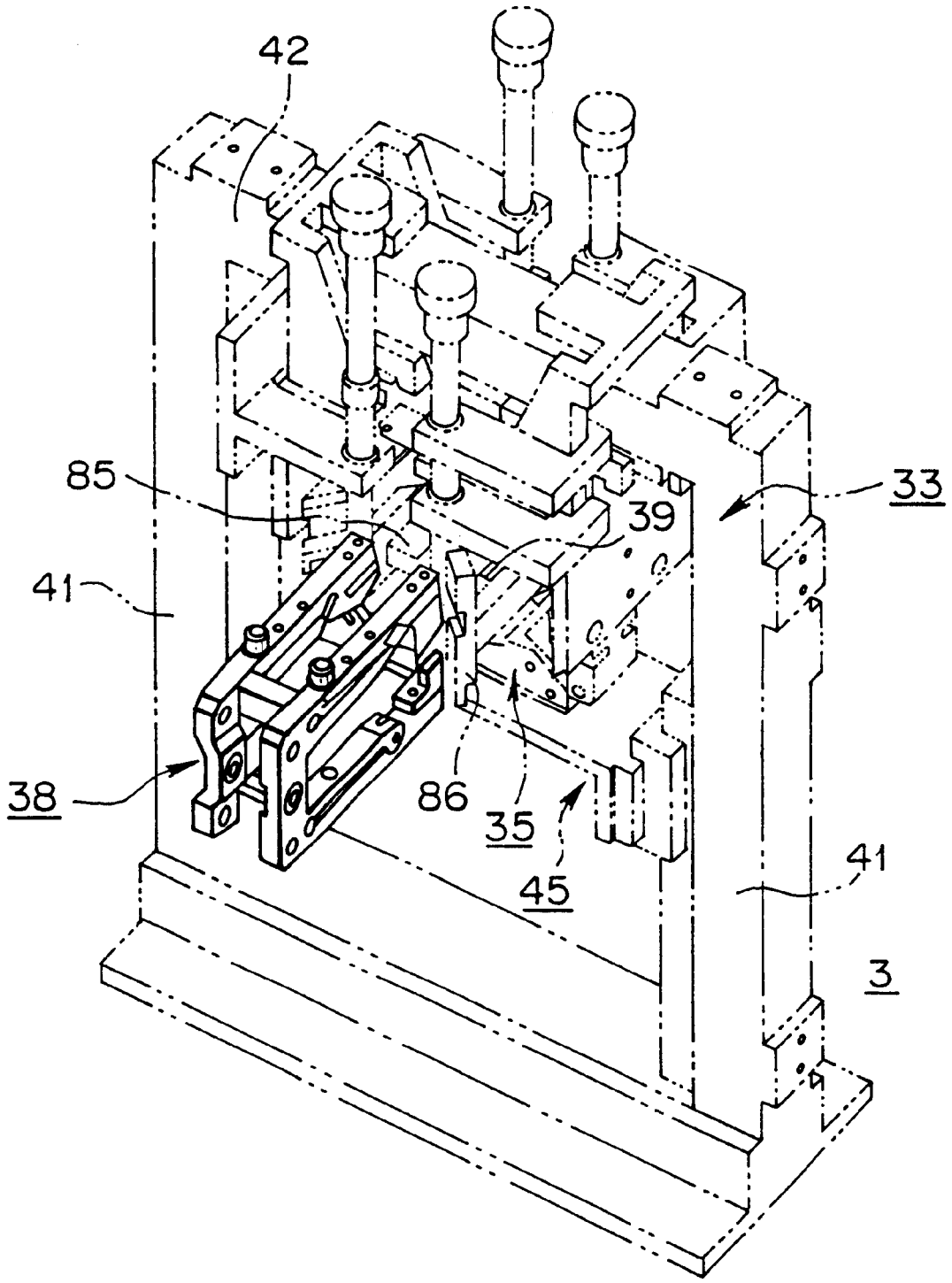
FIG. 12 is a perspective view showing disposition of the folding-line-forming device in the embodiment of the present invention.
Figure 13:
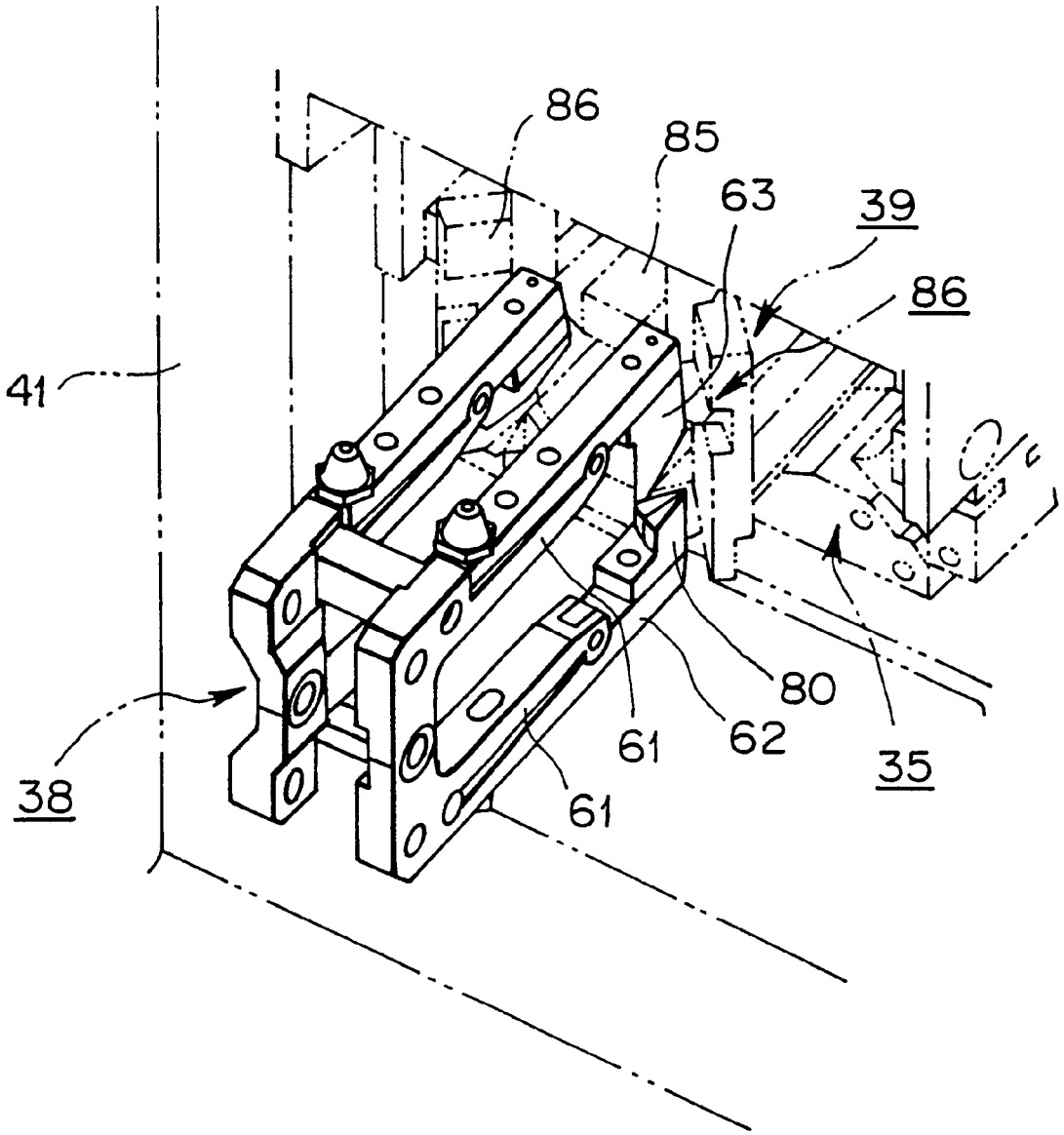
FIG. 13 is a perspective view of the folding-line-forming device and folding mechanism in the embodiment of the present invention.

As shown in FIGS. 12 and 13, the folding mechanisms 39 are disposed opposite to each other in the longitudinal direction (conveyance direction) of the semi-finished package 2 (FIG. 9). Each folding mechanism 39 includes a pressing member 85 for pressing the widthwise intermediate portion of the sealed portion 2*a* or 2*b* of the semi-finished package 2 and deforming both side portions of the sealed portion 2*a* or 2*b* along the folding lines to thereby form the flaps 90 (FIG. 3), and folding members 86 for folding the flaps 90 onto the end faces along the folding lines.

When the folding-line forming devices 38 form folding lines in both side portions of each of the sealed portions 2*a* and 2*b*, the pressing members 85 press the end faces of the semi-finished package 2 except the flaps 90. Each pressing member 85 has a plurality of unillustrated hot-air outlets formed therein. When the pressing member 85 presses the end face of the semi-finished package 2, hot air is discharged from the hot-air outlets and blows the end face in predetermined positions; i.e., hot air blows the portions of the end face to overlap with the flaps 90. Reference numeral 3 denotes the base, numeral 33 denotes the support frame, numeral 35 denotes the lower die, numeral 41 denotes the vertical frame members, numeral 42 denotes the horizontal frame member, numeral 45 denotes the lift mechanism, numeral 61 denotes the turnable arms, numeral 62 denotes the bending arms, and numerals 63 and 80 denote the folding-line applicators.

Next, the folding member 86 will be described with reference to FIGS. 14–17.

Each folding member 86 includes a rotary support plate 87 and a pad member 89 mounted fixedly onto the folding surface 88 of the rotary support plate 87. The rotary support plates 87 are swingably supported by respective shafts disposed vertically in relation to the base 3 (FIG. 1), disposed opposite to both side portions of each of the sealed portions 2*a* (FIG. 9) and 2*b*, and turned by unillustrated turning means.

Figure 14:
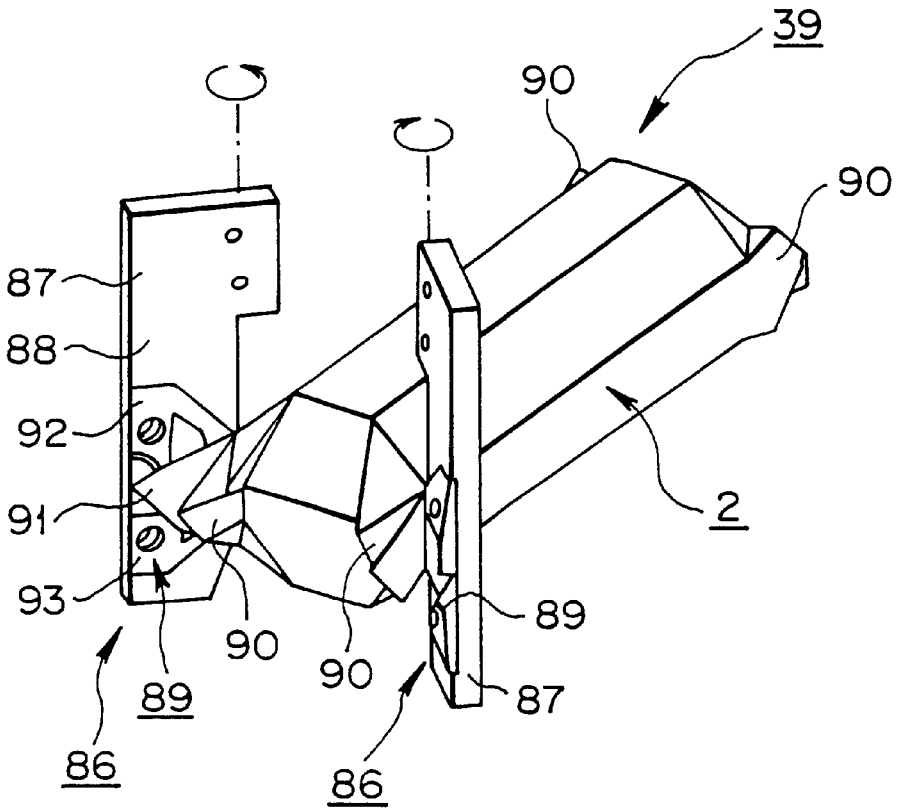
FIG. 14 is a perspective view of the folding mechanism in the embodiment of the present invention.
Figure 15:
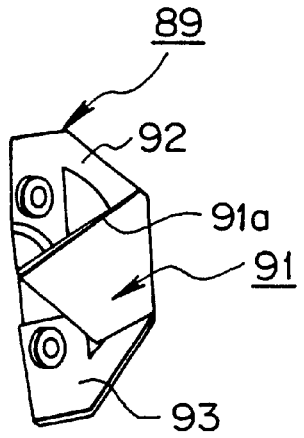
FIG. 15 is a front view of the pad member of the folding mechanism in the embodiment of he present invention.
Figure 16:
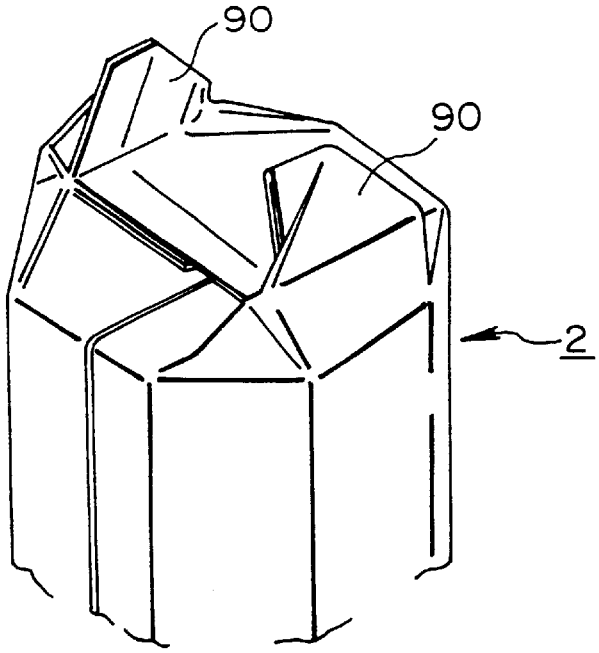
FIG. 16 is a first perspective view showing the procedure of processing the end face of a semi-finished package in the embodiment of the present invention.

As shown in FIGS. 14 and 15, the pad member 89 includes a flap receiving recess 91 for receiving each of the flaps 90 formed at both side portions of each of the sealed portions 2*a* and 2*b* of the semi-finished package 2 and end-face-pressing protrusions 92 and 93 formed at the both sides of the flap receiving recess 91 for pressing the end face (excluding portions which overlap the flaps 90) of the semi-finished package 2. In this case, since the inner wall 91*a* of the flap receiving recess 91 has a shape corresponding to the profile of the flap 90, the flap 90 can be reliably received in the flap receiving recess 91. Also, since the end face of the semi-finished package 2 is pressed on both sides of the flap receiving recess 91, the flap 90 does not come off the flap receiving recess 91. Thus, the flap 90 can be reliably folded.

Figure 17:
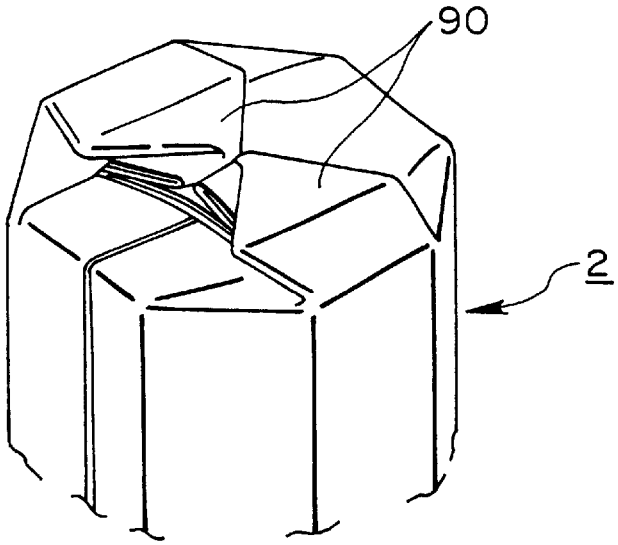
FIG. 17 is a second perspective view showing the procedure of processing the end face of a semi-finished package in the embodiment of the present invention.

In the folding mechanism 39, when the rotary support plates 87 are turned toward the end face of the semi-finished package 2, the formed flaps 90 are received by the respective flap receiving recesses 91. When the rotary support plates 87 are turned further, the flaps 90 are folded onto the end face of the semi-finished package 2. That is, when the rotary support plates 87 are turned in the state shown in FIG. 16, the flaps 90 can be folded onto the end face of the semi-finished package 2 as shown in FIG. 17. At this time, since in the end face of the semi-finished package 2 the surfaces of the portions which have been exposed to hot air discharged from unillustrated hot-air outlets are melted, the flaps 90 are bonded onto the end face of the semi-finished package 2 when folded onto the end face.

Accordingly, even when the flaps 90 rise with respect to the sealed portions 2*a* and 2*b* during temporary folding effected to form folding lines, the flaps 90 are received by the respective flap receiving recesses 91 through the turning of the rotary support plates 87. Thus, the flaps 90 have no play. Also, even when a thick packaging material, a highly rigid packaging material, or a like packaging material is used, the flaps 90 can be reliably folded onto the end face of the semi-finished package 2. Thus, folding can be done as designed to thereby improve the appearance of the final package 5 (FIG. 4).

In the folding mechanisms 39, the flaps 90 are folded onto the end faces of the semi-finished package 2 and also bonded onto the end faces through melting. Thus, the final package 5 can be formed promptly and reliably.

After the flaps 90 are folded and bonded onto the end faces as described above, the semi-finished package 2 is formed into an octagonal prism shape by the upper die 34 (FIG. 7) and the lower die 35, whereby the final package 5 is formed. The thus-formed final package 5 is conveyed to the delivery section 7 by the final package conveyance mechanism 9.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention is applicable to a package manufacturing apparatus for manufacturing packages containing drinks such as milk, juice, tea, and the like.

What is claimed is:

1. A package manufacturing apparatus comprising:

(a) a pair of arm means swingably disposed opposite to each other;

(b) folding-line applicators, while each of said arm means turns, said folding-line applicators nipping a portion-to-be-processed of a package in process of forming, forming a predetermined folding line in the portion-to-be-processed, and temporarily folding the portion-to-be-processed along the folding line; and (c) elastic contact means disposed between one of said folding-line applicators and said corresponding arm means in order to elastically bring said folding-line applicator into contact with the portion-to-be-processed.

2. A package manufacturing apparatus according to claim 1, wherein said elastic contact means comprises a bending arm which is disposed swingably in relation to said arm means and on the tip end portion of which is fixed said folding-line applicator, and urging means which is disposed between said arm means and said bending arm and urges said folding-line applicator toward the portion-to-be-processed.

3. A package manufacturing apparatus according to claim 2, wherein each of said arm means has two turnable arms disposed to face both widthwise end portions of the portion-to-be-processed.

4. A package manufacturing apparatus according to claim 1, wherein each of said arm means has two turnable arms disposed to face both widthwise end portions of the portion-to-be-processed.

5. A package manufacturing apparatus according to claim 4, wherein each of said bending arms is independently supported by said corresponding turnable arm, and said urging means is disposed between said turnable arm and said bending arm.

6. A package manufacturing apparatus comprising:

(a) conveyor means for transporting packages, each package having a portion-to-be-processed, along a conveyance path;

(b) a guide block disposed at a fixed position on said conveyance path; and (c) moving means for moving the package relative to said guide block, through a linear path;

(d) said guide block having a groove defined by two wall portions, at least one of which is slanted relative to said linear path and toward the other of the two wall portions so that said groove gradually narrows away from an opening at said conveyance path and so that the portion-to-be-processed, with one end abutting said slanted wall portion, is folded as the package is moved through said linear path, away from said opening, to thereby form a flap.

7. A package manufacturing apparatus according to claim 6, wherein:

(a) said portion-to-be-processed is a sealed portion; and (b) said moving means moves said package in a direction perpendicular to the conveyance path and to the sealed surface of said sealed portion.

8. A package manufacturing apparatus according to claim 6, wherein said groove portion includes a leading portion for leading the portion-to-be-processed from the opening and along said linear path, and one of said two wall portions at the leading portion is partially cut.

9. A package manufacturing apparatus according to claim 6, wherein a pair of said grooves are provided at opposing sides of said one end, each of said grooves being defined by said diverging wall portions.

10. A package manufacturing apparatus comprising:

(a) a pair of turnable support plates which are mounted for swinging toward and away from each other and in correspondence with flaps at a sealed end of a package in process of forming and which are spaced apart to receive the sealed end therebetween, for pressing said flaps against the end face of said package while turning; and (b) turning means for turning said turnable support plates, (c) said turnable support plate having a folding surface and a flap receiving recess with a surface recessed from said folding surface, for receiving and seating said flap therein.

11. A package manufacturing apparatus according to claim 10, wherein (a) a pad member is attached onto said turnable support plate; and (b) said flap receiving recess is formed in said pad member.

12. A package manufacturing apparatus according to claim 11, wherein end-face-pressing protrusions for pressing the end face of said package are formed on opposing sides of said flap receiving recess.

13. A package manufacturing apparatus according to claim 11, wherein said flap receiving recess has a shape corresponding to that of said flap.

14. A package manufacturing apparatus according to claim 10, wherein said recessed surface is planar and parallel to said folding surface.

* * * * *